US007308744B2

(12) United States Patent
Mikota

(10) Patent No.: US 7,308,744 B2
(45) Date of Patent: Dec. 18, 2007

(54) APPARATUS FOR NEEDLING A NON-WOVEN MATERIAL

(75) Inventor: Gudrun Mikota, Linz (AT)

(73) Assignee: Neumag Saurer Austria GmbH, Leonding (AT)

( * ) Notice: Subject to any disclaimer, the term of this patent is extended or adjusted under 35 U.S.C. 154(b) by 0 days.

(21) Appl. No.: 11/588,758

(22) Filed: Oct. 27, 2006

(65) Prior Publication Data

US 2007/0101562 A1 May 10, 2007

(30) Foreign Application Priority Data

Oct. 27, 2005 (AT) ..... A 1750/2005

(51) Int. Cl.
*D04H 18/00* (2006.01)

(52) U.S. Cl. ..... 28/107; 28/114

(58) Field of Classification Search ..... 28/107, 28/114, 115, 113, 112, 111, 108–110; 92/2, 92/146, 193

See application file for complete search history.

(56) References Cited

U.S. PATENT DOCUMENTS 3,129,486 A * 4/1964 O'Byrne ..... 28/110
3,216,082 A * 11/1965 Stansfield ..... 28/110
3,561,081 A * 2/1971 Fehrer ..... 28/110
3,731,592 A * 5/1973 Kreiskorte ..... 91/178
3,798,717 A * 3/1974 Brochetti ..... 28/107
3,810,284 A * 5/1974 Brochetti ..... 28/110
3,813,741 A * 6/1974 Brochetti ..... 28/110
3,909,891 A 10/1975 Dilo
4,544,108 A * 10/1985 Maurer ..... 242/481.1
4,650,008 A * 3/1987 Simson ..... 92/117 A
5,390,399 A * 2/1995 Dilo ..... 28/109
5,909,883 A * 6/1999 Jourde et al. ..... 28/114
6,161,269 A * 12/2000 Dilo et al. ..... 28/114
2001/0005927 A1* 7/2001 Ruiz et al. ..... 28/107

FOREIGN PATENT DOCUMENTS

DE 1 635 634 7/1970

* cited by examiner

*Primary Examiner*—Amy B. Vanatta
(74) *Attorney, Agent, or Firm*—Collard & Roe, P.C.

(57) ABSTRACT

An apparatus is described for needling a non-woven material with at least one needleboard (23) which is connected with push rods (26) guided in the needle-penetration direction and with at least one drive for the needleboard (23) acting upon the push rods (26). In order to provide advantageous drive conditions it is proposed that the drive is arranged as a hydrostatic resonance drive which comprises at least one working cylinder (1) with a piston (2) pressurized on both sides by a hydraulic spring (4, 5) each and a device for pressurizing the piston (2) with a frequency which corresponds to the resonance frequency of the oscillation system obtained from the moved masses and the hydraulic springs (4, 5).

7 Claims, 4 Drawing Sheets

APPARATUS FOR NEEDLING A NON-WOVEN MATERIAL

FIELD OF THE INVENTION

The invention relates to an apparatus for needling a non-woven material with at least one needleboard which is connected with push rods guided in the needle-penetration direction and with at least one drive for the needleboard acting upon the push rods.

DESCRIPTION OF THE PRIOR ART

For the purpose of needling a non-woven material, the needleboard which is equipped with respective needles, must be driven in a reciprocating direction in the needle-penetration direction relative to the non-woven material which is conveyed between a stitch base and the needleboard in the longitudinal direction. The needleboard, which is usually detachably held in a needle bar, is guided by means of two push rods which act upon the needle bar and to which the connecting rods of an eccentric drive are linked. Apart from the fact that these eccentric drives naturally come with all such disadvantages which are connected to the conversion of a rotational movement into a straight needle-penetration movement, the known eccentric drives lead to increasing difficulties when it is intended to increase the needle-penetration frequency for the needleboards.

SUMMARY OF THE INVENTION

The invention is thus based on the object of providing an apparatus for needling a non-woven material of the kind mentioned above in such a way that higher needle-penetration frequencies can even be ensured with comparatively simply constructional means.

This object is achieved by the invention in such a way that the drive is arranged as a hydrostatic resonance drive which comprises at least one working cylinder with a piston pressurized on both sides by a hydraulic spring each and a device for pressurizing the piston with a frequency which corresponds to the resonance frequency of the oscillation system obtained from the moved masses and the hydraulic springs.

By forming the drive as a hydrostatic resonance drive, the conversion of a rotational movement into a reciprocating linear movement via an eccentric drive is prevented by using at least one working cylinder. The desired high needle-penetration frequencies are achieved with a comparatively low input of energy by providing an oscillation system which comprises two hydraulic springs which are effective in opposite directions and are excited in the resonance range in such a way that a piston pressurized via the two hydraulic springs is displaced with the resonance frequency of this oscillation system in a working cylinder. Since the resonance frequency is determined by the resulting stiffness of the two hydraulic springs on the one hand, and by the oscillating masses on the other hand, and the spring stiffness depends on the effective piston surface and the hydraulic capacity which is obtained from the volume and modulus of elasticity of the hydraulic medium, both the effective piston surface as well as the required spring volume can be determined for a predetermined resonance frequency, a predetermined oscillation amplitude and a permissible pressure amplitude from the known physical correlations.

Due to the lack of eccentric drives, drive-induced transversal forces are omitted, leading to simple constructional conditions, especially when at least two working cylinders are provided whose piston rods connected with the pistons are arranged as push rods.

Despite the needle-penetration direction predetermined by the working cylinder(s), it is possible to provide the needleboard with an additional reciprocating direction in the direction of passage of the non-woven material in order to increase the conveying speed for the non-woven material as a result of the movement component of the needleboard which acts during the needle penetration in the direction of passage of the non-woven material. For this purpose, the needleboard with the hydrostatic resonance drive merely needs to form a module which is rotatably held transversally to the direction of passage of the non-woven material, with an oscillating drive which is synchronous relative to the hydrostatic resonance drive acting upon said module. Said oscillating drive can consist in a conventional way of an eccentric drive. Advantageous constructional conditions are obtained however when the oscillating drive for a needleboard movement in the direction of passage of the non-woven material is also arranged as a hydrostatic resonance drive with a working cylinder and a piston pressurized on both sides by hydraulic springs.

The hydraulic springs can be housed in housings which are connected via respective pressure conduits to the pressure chambers of the working cylinder. Simpler constructional conditions are obtained however when the working cylinder is provided with an open configuration on at least one face side and projects with the open face side into the housing of the associated hydraulic spring, so that separate pressure conduits between the working cylinder and the housing of the hydraulic spring can be omitted.

For the purpose of mass balancing, the drive can comprise an equiaxed compensating cylinder in addition to the working cylinder, with the working cylinder and the compensating cylinder being connected in a hydraulic way with each other on the same piston side and are connected on the opposite side to a hydraulic spring each. A piston movement of the compensating cylinder which is in the opposite direction to the working cylinder is thus ensured via the compensating cylinder, so that in the case of a respective allocation of a balancing mass to the piston of the compensating cylinder a balancing of mass is achieved, which also occurs under resonance conditions for the balancing mass.

As was already explained, the natural frequency depends on the volume of the hydraulic springs with the other parameters remaining the same. An influence on the natural frequency can thus also be made via the spring volume. For the purpose of adjusting the natural frequency, the volume of the housing can be provided with an adjustable configuration for one of the two hydraulic springs of the working cylinder, e.g. with the help of an actuating cylinder.

BRIEF DESCRIPTION OF THE DRAWINGS

The subject matter of the invention is shown in the drawing by way of example, wherein.

DESCRIPTION OF THE PREFERRED EMBODIMENTS

Figure 1:
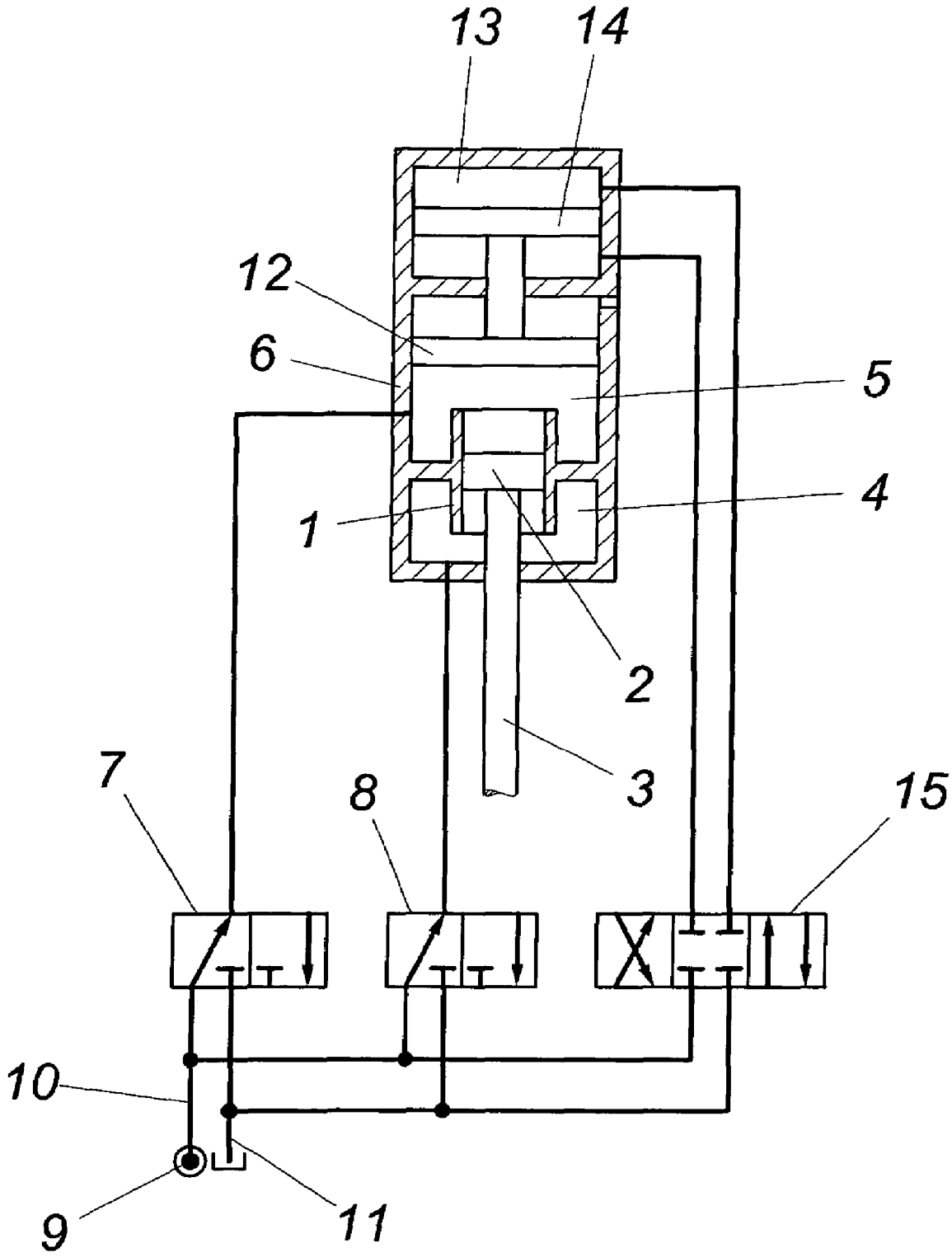
FIG. 1 shows a drive for an apparatus in accordance with the invention for needling a non-woven material in a simplified block diagram.

As is shown in FIG. 1, a hydrostatic resonance drive comprises a piston 2 with a piston rod 3 which is guided in a working cylinder 1 and which is pressurized on both sides by a hydraulic spring 4 and 5 each. Said hydraulic springs 4 and 5 comprise a housing 6 which is filled with a hydraulic medium and which must be provided with a respectively stiff configuration in order to allow absorbing the pressure amplitudes. In order to provide compact constructional conditions, the working cylinder 1 is open on both face sides and opens with the open face sides into the housing 6 for the two hydraulic springs 4, 5, so that the piston can be pressurized directly by the hydraulic springs 4 and 5. In order to enable setting the biasing pressure of the two hydraulic springs 4, 5 and exciting the pressure 2 into oscillations, two control valves 7, 8 are connected to the two hydraulic springs 4 and 5 which can thus be connected either with a pressure conduit 10 supplied by a pump 9 or with a return conduit 11 for the hydraulic medium depending on the slider position of the control valves 7, 8. When the piston 2 is made to oscillate with a frequency via the control valve 7 for example which corresponds to the resonance frequency of the oscillation system formed from the moved masses and the two hydraulic springs 4 and 5, an oscillation drive can advantageously be ensured via the piston rod 3 which not only leads to a comparatively simple configuration, but can also be operated in an energy-saving way. The two control valves 7, 8 also allow setting the middle position of the piston 2.

The resonance frequency of the oscillation system can be set by changing the resulting spring stiffness. The volume of the housing 6 can be adjusted for this purpose for at least one of the two hydraulic springs 4, 5. In the embodiment according to FIG. 1, this is provided for the hydraulic spring 5, which occurs with the help of a piston 12 which is displaced by an actuating cylinder 13. The actuating piston 14 is pressurized via an actuating valve 15 and held in the respectively chosen piston position.

Figure 2:
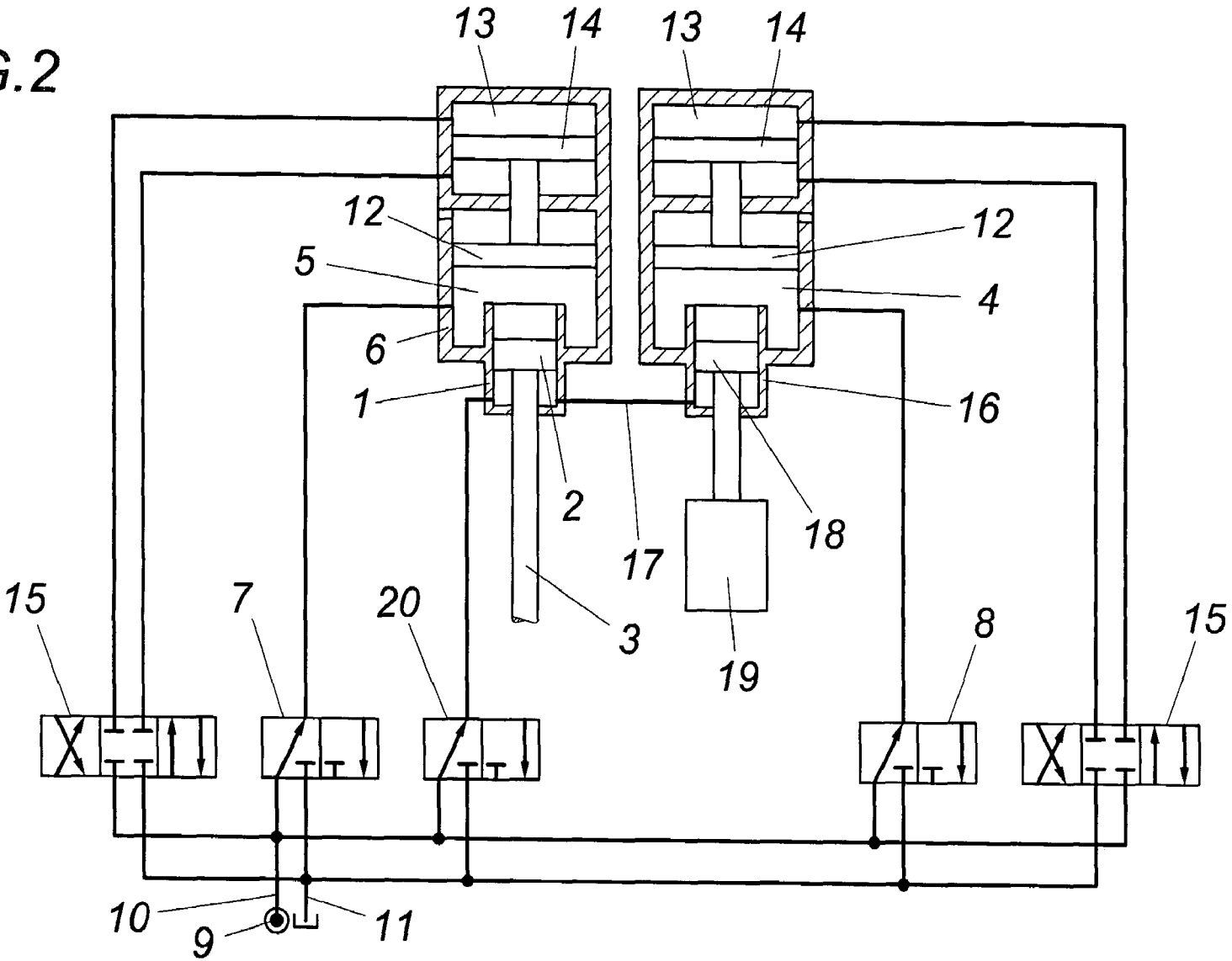
FIG. 2 shows the drive according to FIG. 1 which is supplemented by balancing of masses.

In order to create in a comparatively simple way a balancing of masses for the oscillation drive, it is possible in accordance with FIG. 2 to provide an equiaxed compensating cylinder 16 adjacent to the working cylinder 6, which compensating cylinder is coupled hydraulically with the working cylinder 1 via a line connection 17 on the same piston side, so that the piston 18 of the compensating cylinder 16 is displaced in the opposite direction to the piston 2 of the working cylinder 1, which ensures a substantial balancing of masses in the case of a respective adjustment of the masses, for example by means of a balancing mass 19. The hydraulic springs 4 and 5 pressurize in this case the working cylinder 1 on the one hand and the compensating cylinder 16 on the other hand.

To ensure that the middle position 2, 18 of the working cylinder 1 and the compensating cylinder 16 can be set independent of each other with respect to their middle position, a further control valve 20 is provided. The setting of the resonance frequency occurs according to the measures taken for working cylinder 1 by a piston 12 which is connected with an actuating piston 14 in an actuating cylinder 13 and is triggered via an actuating valve 15.

As a result of the arrangement of the cylinders 1 and 16 parallel next to one another, a free moment of mass occurs despite the balancing of masses in the direction of stroke of pistons 2 and 18, which free moment of mass can be avoided when the cylinders 1 and 16 are arranged in a coaxial manner.

Figure 3:
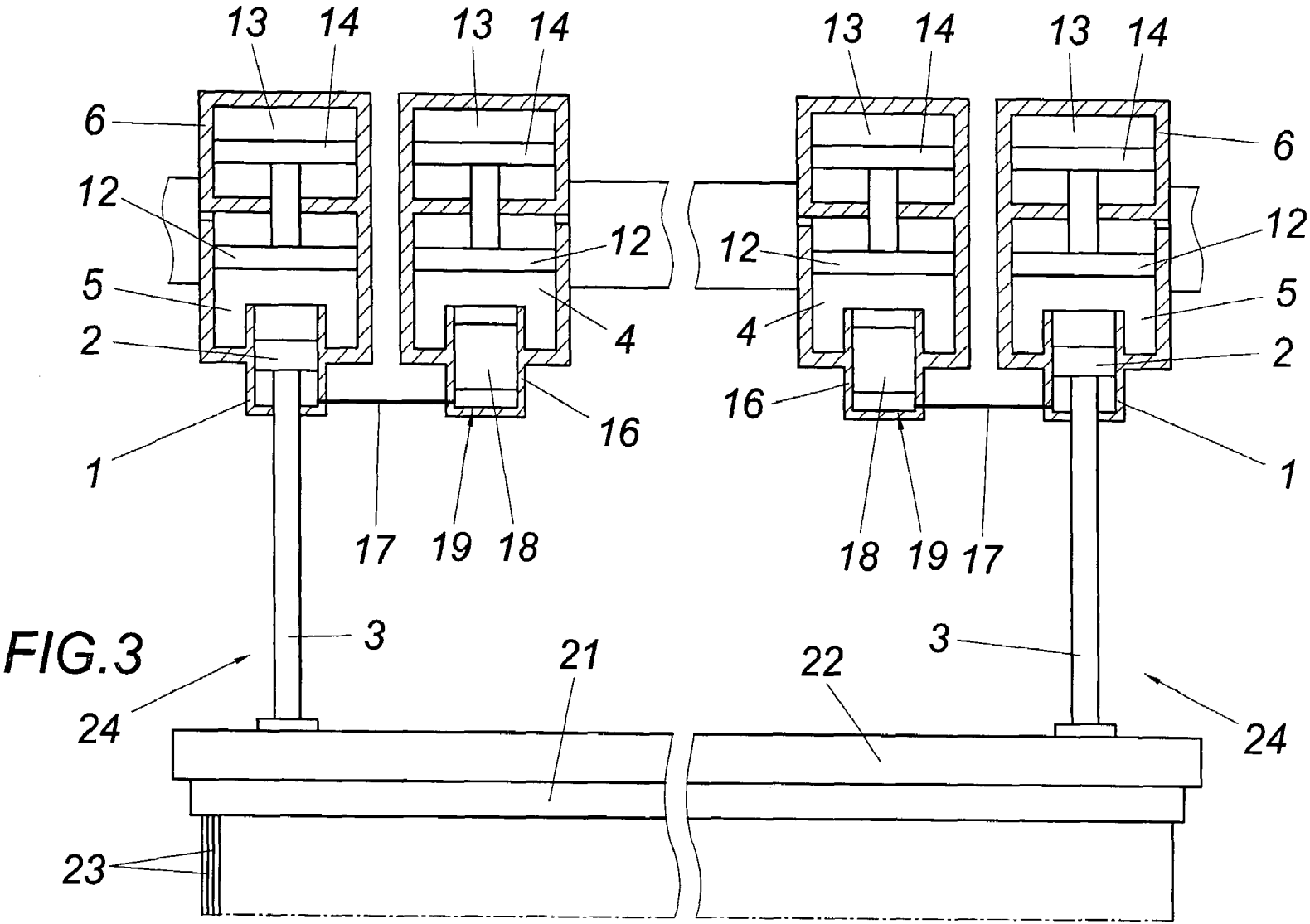
FIG. 3 shows a needleboard driven with the help of a hydrostatic resonance drive according to FIG. 2 in a partly sectional, schematic view in the direction of passage of the non-woven material.

FIG. 3 shows a needleboard 21 in a view in the direction of passage of the non-woven material, which needleboard 21 is detachably fastened in a conventional manner with a needle bar 22. The needle bar 22 is connected with parallel push rods 24 for driving the needleboard 21 in the needle-penetration direction of the needles 23, which push rods each form a piston rod 3 of a hydrostatic resonance drive, as is shown in FIG. 2 in closer detail. In contrast to the embodiment according to FIG. 2, the pistons 18 of the compensating cylinders 16 form the balancing mass 19. The needleboard 21 is thus driven by the hydrostatic resonance drive acting upon the two push rods 24 with a needle-penetration frequency which corresponds to the resonance frequency of said drive. It is merely necessary to ensure the synchronization of the two working cylinders, which can be made in a hydraulic or mechanical manner or by means of control technology.

Figure 4:
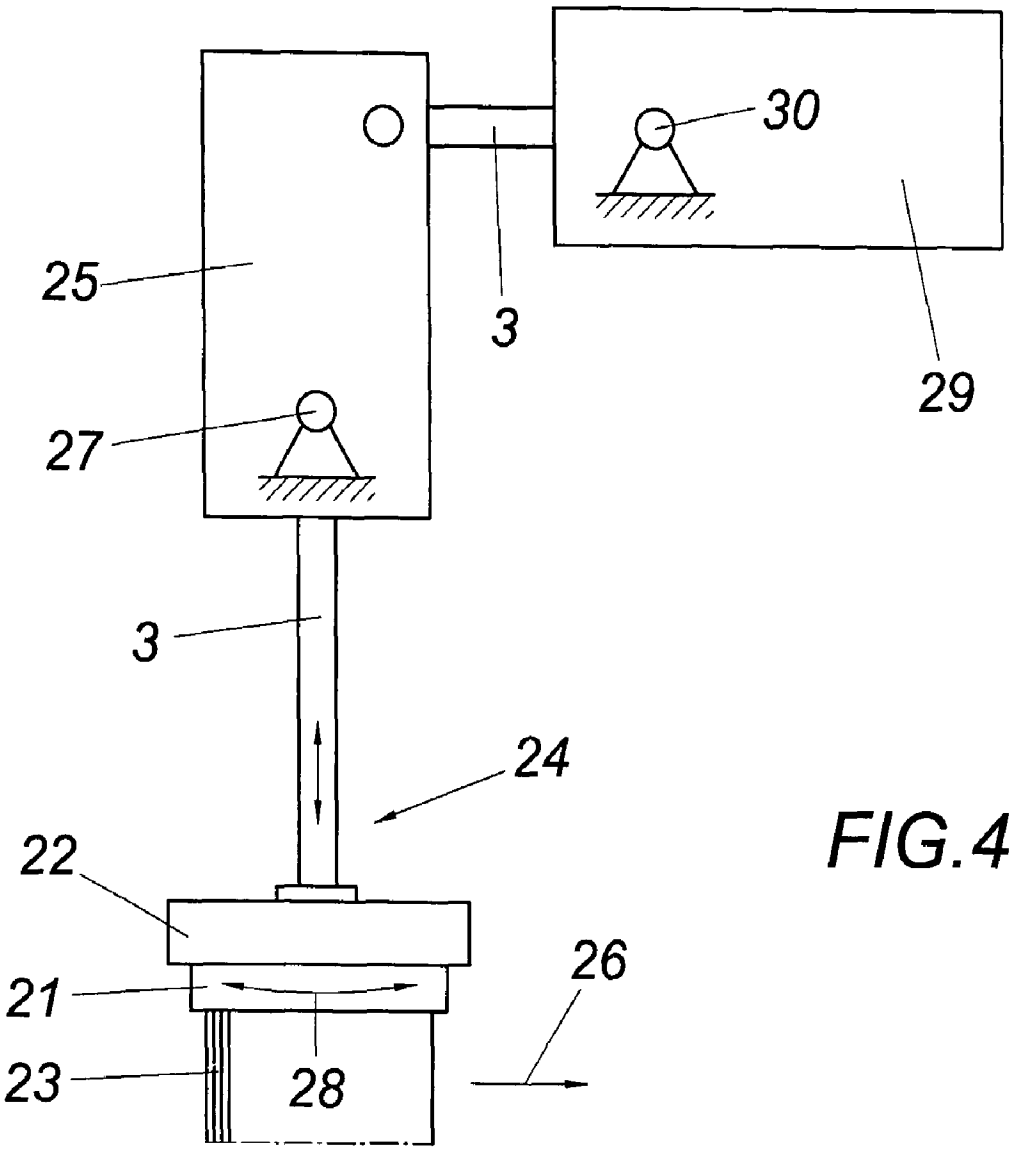
FIG. 4 shows a schematic side view of a needleboard which is driven with the help of hydrostatic resonance drives both in the needle-penetration direction as well as in the direction of passage of the non-woven material.

According to FIG. 4, which shows a needleboard 21 in a side view, the resonance drive with the piston rods 3 is combined into a module 25 which is held in a pivoting manner in a frame about an axis 27 extending transversally to the direction of passage 26 of the non-woven material. As a result of this pivoting bearing of the module 25, the needleboard 21 can be displaced in a reciprocating manner in the direction of passage 26 of the non-woven material, as is indicated by the arrows 28. The pivoting drive 29 for said additional movement of the needleboard 21 can be provided with a different configuration and consist in a conventional manner of an eccentric drive. Especially advantageous drive conditions are obtained however when the pivoting drive 29 is also formed by a hydrostatic resonance drive, as is shown in FIGS. 1 and 2. In this case, the module formed by the resonance drive must be provided with a configuration so as to be held in a pivoting manner about the axis 30 which is fixed to the frame in order to link the piston rod 3 without any intermediate bar linkage directly to the module 25, as is shown in FIG. 4.

The invention claimed is:

1. An apparatus for needling a non-woven material comprising:

(a) at least one needle-board;

(b) a plurality of push rods connected to said at least one needle-board, said push rods being guided in a needle penetration direction; and (c) at least one drive for the at least one needle-board comprising a hydrostatic resonance drive, said hydrostatic resonance drive comprising at least one working cylinder, a piston having first and second sides pressurized respectively on said first and second sides by first and second hydraulic springs, and a piston pressurizing drive for pressurizing the piston with a frequency corresponding to a resonance frequency of an oscillation system obtained from moved balancing masses and the hydraulic springs.

2. The apparatus according to claim 1, wherein the at least one needle-board forms with the hydrostatic resonance drive a module rotatably held transversally to a direction of passage of the non-woven material and is acted upon by an oscillation drive.

3. The apparatus according to claim 2, wherein the oscillation drive is formed as a hydrostatic resonance drive with a working cylinder and a piston pressurized on both sides by hydraulic springs.

4. The apparatus according to claim 1, wherein each of the first and second hydraulic springs is contained in an associated housing and the working cylinder has an open configuration on at least one face side and projects with the open face side into the housing.

5. The apparatus according to claim 1, wherein the at least one drive comprises an equiaxed compensating cylinder in addition to the working cylinder, with the working cylinder and the compensating cylinder being connected in a hydraulic way with each other on the same piston side and connected on the opposite side to a respective hydraulic spring, the compensating cylinder having an associated piston carrying a balancing mass.

6. The apparatus according to claim 4, wherein the housing has an adjustable volume at least for one of the two hydraulic springs of the working cylinder.

7. An apparatus for needling a non-woven material comprising:

(a) at least one needle-board; and (b) at least one drive for the at least one needle-board comprising a hydrostatic resonance drive, said hydrostatic resonance drive comprising at least first and second working cylinders, first and second pistons guided respectively in said first and second working cylinders, said first working cylinder having a first piston rod connected with the first piston and said second working cylinder having a second piston rod connected with the second piston, each piston having first and second sides pressurized respectively on said first and second sides by first and second hydraulic springs, and a piston pressurizing drive for pressurizing the pistons with a frequency corresponding to a resonance frequency of an oscillation system obtained from moved balancing masses and the hydraulic springs, the piston rods forming push rods connected to said at least one needle-board and guided in a needle penetration direction.

* * * * *